US010719040B2

(12) United States Patent
Tsubotani et al.

(10) Patent No.: US 10,719,040 B2
(45) Date of Patent: Jul. 21, 2020

(54) FIXING DEVICE CONTAINING HEATING MEMBER, NIP AREA MEMBER, FIXING BELT, PRESSING MEMBER, AND PROTRUSION, AND IMAGE FORMING APPARATUS

(71) Applicant: Konica Minolta, Inc., Tokyo (JP)

(72) Inventors: Yoshikazu Tsubotani, Toyokawa (JP); Yusuke Mamiya, Nagoya (JP); Motoki Nakano, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/698,773

(22) Filed: Sep. 8, 2017

(65) Prior Publication Data

US 2018/0081310 A1 Mar. 22, 2018

(30) Foreign Application Priority Data

Sep. 21, 2016 (JP) ..... 2016-184129
Sep. 21, 2016 (JP) ..... 2016-184130
Sep. 21, 2016 (JP) ..... 2016-184131

(51) Int. Cl.
*G03G 15/20* (2006.01)

(52) U.S. Cl.
CPC ..... *G03G 15/2025* (2013.01); *G03G 15/2028* (2013.01); *G03G 15/2053* (2013.01);
(Continued)

(58) Field of Classification Search
CPC ..... G03G 15/2085; G03G 15/2025; G03G 15/2053; G03G 15/2028; G03G 15/2064;
(Continued)

(56) References Cited

U.S. PATENT DOCUMENTS 6,980,764 B2 * 12/2005 Otsuka ..... G03G 15/2053 399/328
2001/0019676 A1 * 9/2001 Okubo ..... G03G 15/2064 399/328

(Continued)

FOREIGN PATENT DOCUMENTS

JP 2001203062 A 7/2001
JP 2004302449 A 10/2004

(Continued)

OTHER PUBLICATIONS

JPO, Office Action for the related Japanese patent application No. 2016-184130, dated Mar. 31, 2020, with English translation.

(Continued)

*Primary Examiner* — Walter L Lindsay, Jr.
*Assistant Examiner* — Laura Roth
(74) *Attorney, Agent, or Firm* — Lucas & Mercanti, LLP

(57) ABSTRACT

A fixing device is for fixing a toner image on a recording medium an image forming apparatus. The fixing device includes a fixing belt, a heating member, a nip area member, a pressing member, and a protrusion. The fixing belt is held by the heating member and the nip area member. The pressing member presses the fixing belt against the nip area member while being rotationally driven. The toner image is fixed on the recording medium in a nip area where the pressing member presses the fixing belt against the nip area member. The protrusion is in contact with the inner surface of the fixing belt. In the fixing device, the fixing belt is in contact with small areas only other than the heating area and the nip area to reduce the heat loss.

13 Claims, 4 Drawing Sheets

(52) U.S. Cl.
CPC . *G03G 15/2064* (2013.01); *G03G 2215/2035* (2013.01); *G03G 2215/2038* (2013.01)

(58) Field of Classification Search
CPC ..... G03G 15/2075; G03G 2215/2038; G03G 2215/2035
See application file for complete search history.

(56) References Cited

U.S. PATENT DOCUMENTS

| | | | | |
|---|---|---|---|---|
| 2008/0304882 | A1 | 12/2008 | Shin et al. | |
| 2009/0035034 | A1* | 2/2009 | Nagase | G03G 15/2025 399/329 |
| 2009/0232534 | A1* | 9/2009 | Haseba | G03G 15/2039 399/69 |
| 2011/0064451 | A1* | 3/2011 | Yamaguchi | G03G 15/2028 399/99 |
| 2012/0155932 | A1* | 6/2012 | Nakamura | G03G 15/2017 399/329 |
| 2013/0236219 | A1* | 9/2013 | Matsumoto | G03G 15/2053 399/327 |
| 2014/0270869 | A1* | 9/2014 | Okabayashi | G03G 15/2053 399/329 |
| 2014/0286683 | A1* | 9/2014 | Nakamura | G03G 15/2053 399/329 |
| 2015/0198919 | A1* | 7/2015 | Lee | G03G 15/2025 399/329 |
| 2016/0274515 | A1* | 9/2016 | Imada | G03G 15/2053 |
| 2017/0010570 | A1* | 1/2017 | Fujimoto | G03G 15/2053 |
| 2017/0176905 | A1* | 6/2017 | Suzuki | G03G 15/2053 |
| 2017/0364006 | A1* | 12/2017 | Minemura | G03G 15/2053 |
| 2018/0011435 | A1* | 1/2018 | Tsubotani | G03G 15/2028 |

FOREIGN PATENT DOCUMENTS

| | | | |
|---|---|---|---|
| JP | 2004302488 | A | 10/2004 |
| JP | 2006038990 | A | 2/2006 |
| JP | 2008046663 | A | 2/2008 |
| JP | 2009223044 | A | 10/2009 |
| JP | 2009237185 | A | 10/2009 |
| JP | 2010139879 | A | 6/2010 |
| JP | 2011175168 | A | 9/2011 |
| JP | 2012133035 | A | 7/2012 |
| JP | 2013190467 | A | 9/2013 |
| JP | 2013210608 | A | 10/2013 |
| JP | 2014178555 | A | 9/2014 |
| JP | 2014228857 | A | 12/2014 |
| JP | 2014228857 | A * | 12/2014 |
| JP | 2016031453 | A | 3/2016 |
| JP | 2017003606 | A | 1/2017 |

OTHER PUBLICATIONS

JPO, Office Action for the related Japanese patent application No. 2016-184129, dated Mar. 24, 2020, with English translation.
JPO, Office Action for the related Japanese patent application No. 2016-184131, dated Mar. 31, 2020, with English translation.

* cited by examiner

FIXING DEVICE CONTAINING HEATING MEMBER, NIP AREA MEMBER, FIXING BELT, PRESSING MEMBER, AND PROTRUSION, AND IMAGE FORMING APPARATUS

Japanese Patent Application Nos. 2016-184129, 2016-184130, and 2016-184131 all filed on Sep. 21, 2016, including description, claims, drawings, and abstract the entire disclosures are incorporated herein by reference in its entirety.

BACKGROUND

Technological Field

The present invention relates to an image forming apparatus such as a copying machine, a printer, a facsimile, or a multifunctional machine including the functions of these machines, and a fixing device for fixing a toner image, which has been formed on a recording medium, on the recording medium in the image forming apparatus. The present invention relates more particularly to a fixing device including: a fixing belt disposed around a heating member and a nip area member at a fixed position to be held by these members; and a pressing member that presses the fixing belt against the nip area member while being rotationally driven, in which the fixing belt is pressed and rotationally driven by the pressing member while being tensed up, and a toner image is fixed on a recording medium in a nip area where the pressing member presses the fixing belt against the nip area member. In the fixing device, the fixing belt comes into contact with small areas only other than the heating area and the nip area, which reduces the heat loss during the heating and fixing operation.

Description of the Related Art

In a conventional image forming apparatus such as a copying machine, a printer, a facsimile, or a multifunctional machine including the functions of these machines, a toner image, which has been transferred onto a recording medium, is fixed on the recording medium by a fixing device.

For example, JP 2006-38990 A discloses a fixing device in which an endless fixing belt with lubricant on its inner surface is disposed around a heating roller and a nip area member at a fixed position to be held by the heating roller and the nip area member, a pressing roller is rotationally driven to rotationally drive the fixing belt while pressing the fixing belt against the nip area member, and a toner image is fixed on a recording medium in a nip area where the pressing member presses the fixing belt against the nip area member.

In the fixing device of JP 2006-38990 A, however, the fixing belt is in contact with the nip area member in a large area pressed by the pressing roller (a nip area) and also in other areas. In this configuration, the heat provided by the heating roller to the fixing belt is transmitted to the nip area member through the nip area and other areas, which increases the heat loss during the heating and fixing operation. In addition, a large torque is required for rotationally driving the pressing roller to rotationally drive the fixing belt.

JP 2014-228857 A discloses another fixing device in which an endless fixing belt is disposed around a heating roller and a nip area member at a fixed position to be held by the heating roller and the nip area member, a pressing roller is rotationally driven to rotationally drive the fixing belt while pressing the fixing belt against the nip area member, and a toner image is fixed on a recording medium in a nip area where the pressing member presses the fixing belt against the nip area member. In the fixing device of JP 2014-228857 A, however, the diameter of the heating roller is larger than the length of the area of the nip area member pressed by the pressing roller. Such a large heating roller itself is expensive. In addition, heating the fixing belt with this heating roller requires a large amount of electricity, which increases electric costs during the heating and fixing operation.

SUMMARY

The present invention has been made to solve the above problems in a fixing device for fixing a toner image, which has been transferred onto a recording medium, on the recording medium in an image forming apparatus such as a copying machine, a printer, a facsimile, or a multifunctional machine including the functions of these machines.

An object of the present invention is to provide a fixing device including: a fixing belt disposed around a heating member and a nip area member at a fixed position to be held by these members; and a pressing member that presses the fixing belt against the nip area member while being rotationally driven, in which the fixing belt is pressed and rotationally driven by the pressing member while being tensed up, and a toner image is fixed on a recording medium in a nip area where the pressing member presses the fixing belt against the nip area member. In the fixing device, the fixing belt comes into contact with small areas only other than the heating area and the nip area, which reduces the heat loss during the heating and fixing operation.

To achieve the abovementioned object, according to an aspect of the present invention, a fixing device reflecting one aspect of the present invention comprises: a fixing belt disposed around a heating member and a nip area member to be held by the heating member and the nip area member; a pressing member that presses the fixing belt against the nip area member while being rotationally driven, wherein the fixing belt is pressed and rotationally driven by the pressing member, and a toner image is fixed on a recording medium in a nip area where the pressing member presses the fixing belt against the nip area member; and one protrusion disposed upstream of the nip area and/or another protrusion disposed downstream of the nip area in the moving direction of the fixing belt to be in contact with the inner surface of the fixing belt.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, a fixing device and an image forming apparatus including the fixing device according to one or more embodiments of the present invention will be described in detail with reference to the drawings. However, the scope of the invention is not limited to the disclosed embodiments. The embodiments can be modified within the scope of the invention.

Figure 1:
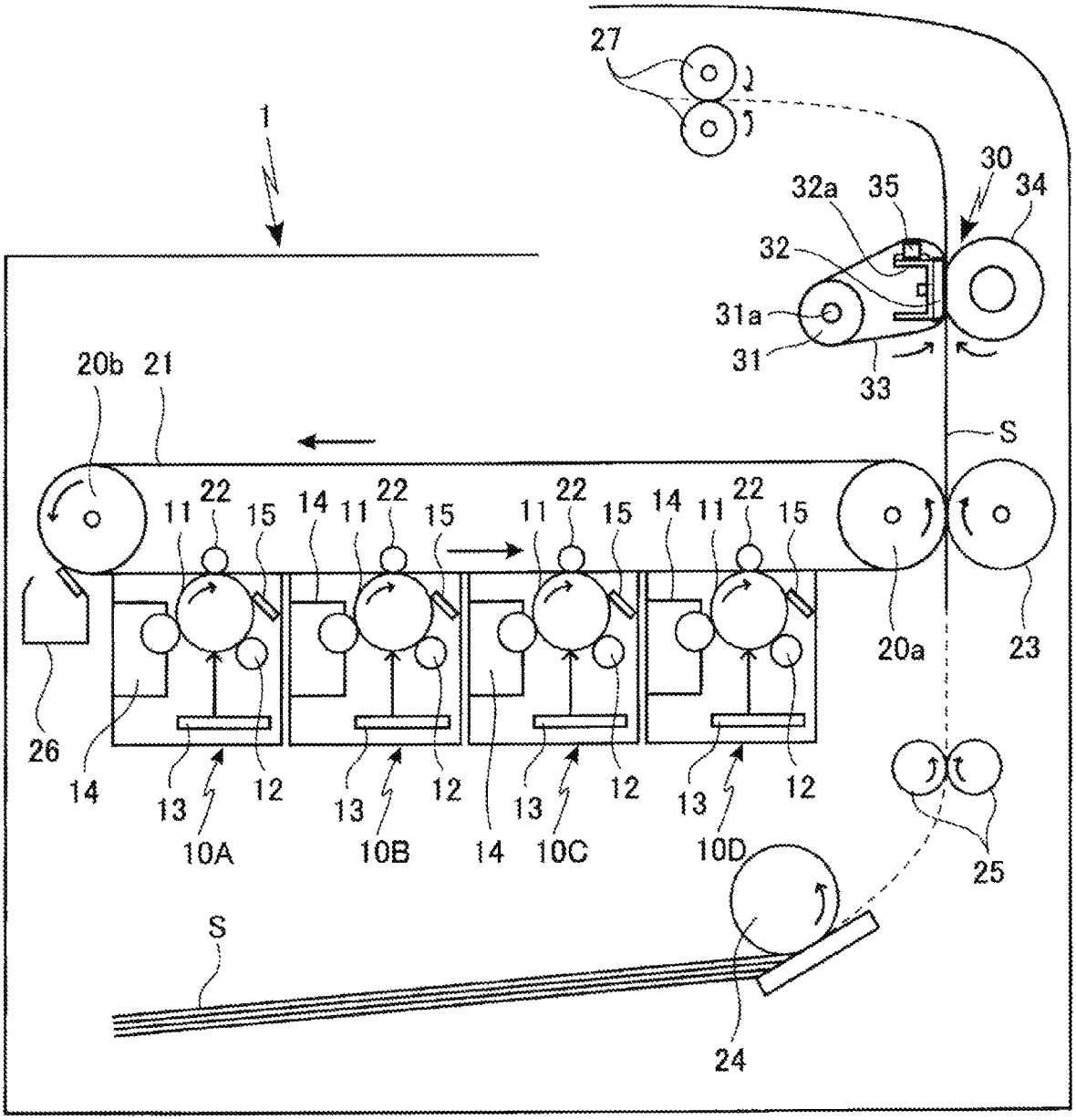
FIG. 1 is a schematic view of an image forming apparatus including a fixing device according to an embodiment of the present invention.

As shown in FIG. 1, an image forming apparatus 1 of this embodiment includes four cartridge units 10A to 10D inside.

Each of the cartridge units 10A to 10D includes a photoconductor drum 11, an electrifying device 12 for electrifying the surface of the photoconductor drum 11, a latent-image forming device 13 for irradiating the electrified surface of the photoconductor drum 11 with light based on image data to form an electrostatic latent image on the surface of the photoconductor drum 11, a toner-image forming device 14 for providing toner to the electrostatic latent image on the surface of the photoconductor drum 11 to form a toner image, and a first cleaning device 15 for removing residual toner from the surface of the photoconductor drum 11 after the toner image is transferred from the surface of the photoconductor drum 11 onto an intermediate transferring belt 21.

In each of the cartridge units 10A to 10D, the toner-image forming device 14 contains toner of one of different colors: black, yellow, magenta, and cyan.

In the image forming apparatus 1, the surface of the photoconductor drum 11 is electrified by the electrifying device 12 and exposed to the light emitted by the latent-image forming device 13 based on image data so that the electrostatic latent image corresponding to the image data is formed on the surface of the photoconductor drum 11 in each of the cartridge units 10A to 10D. The toner-image forming device 14 then provides toner of each color to the electrostatic latent image on the surface of the photoconductor drum 11 to form a toner image of the color on the surface of the photoconductor drum 11.

Individual toner images of different colors on the surfaces of the photoconductor drums 11 in the cartridge units 10A to 10D are then transferred onto the intermediate transferring belt 21 one after the other with the help of respective primary transferring rollers 22 to form a combined toner image on the intermediate transferring belt 21. The intermediate transferring belt 21 is held by a driving roller 20*a* and a driven roller 20*b* and rotationally driven by these rollers. The intermediate transferring belt 21 then carries the combined toner image to the position of a secondary transferring roller 23. After the transfer of the toner image, the residual toner on the surfaces of the photoconductor drums 11 is removed by the respective first cleaning devices 15.

In the image forming apparatus 1, a recording medium S is picked up by a paper supplying roller 24 and led to a pair of timing rollers 25. The timing rollers 25 timely supply the recording medium S to the position between the intermediate transferring belt 21 and the secondary transferring roller 23.

The toner image on the intermediate transferring belt 21 is transferred onto the recording medium S there with the help of the secondary transferring roller 23. After the transfer of the toner image, the residual toner on the intermediate transferring belt 21 is removed by a second cleaning device 26.

The recording medium S now carrying the toner image is led into a fixing device 30, where the unfixed toner image on the recording medium S is fixed on the recording medium S. The recording medium S with the fixed toner image is then led out of the fixing device 30 to a pair of ejecting rollers 27. The ejecting rollers 27 eject the recording medium S with the fixed toner image out of the image forming apparatus 1.

Figure 2:
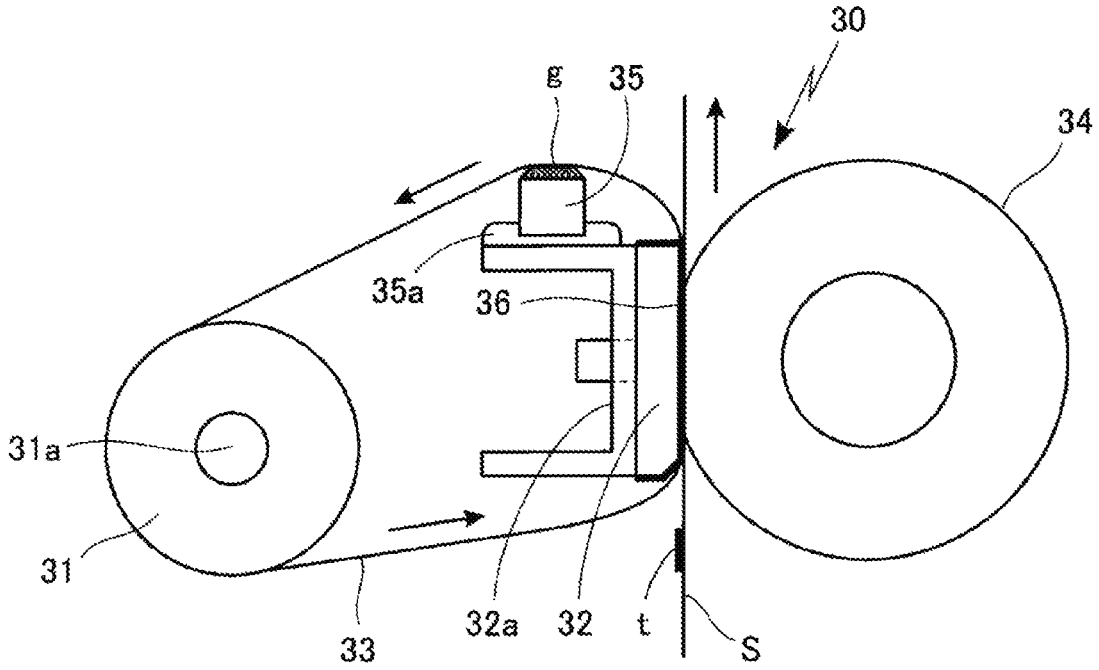
FIG. 2 is a schematic view of the fixing device according to the embodiment.

As shown in FIGS. 1 and 2, the fixing device 30 of this embodiment includes a heating member or roller 31 containing a heater 31*a* such as a halogen lamp for heating a fixing belt 33.

The fixing belt 33 is disposed around the heating roller 31 and a nip area member 32 securely held by a grooved fastening member 32*a* so that the fixing belt 33 is held by the heating roller 31 and the nip area member 32. A pressing member or roller 34 is disposed to press the fixing belt 33 against the nip area member 32. In addition, the fixing belt 33 is tensed up by a tensing means (not shown). In this configuration, when the pressing roller 34 is rotationally driven, the fixing belt 33 is also rotationally driven. After being heated, the fixing belt 33 is subjected to the pressure between the nip area member 32 and the pressing roller 34. The area between the nip area member 32 and the pressing roller 34 is called a nip area. In this area, a toner image t is fixed on the recording medium S by heat and pressure.

In the fixing device 30 of this embodiment, a protrusion 35 is disposed on the fastening member 32*a* via a heat-insulating holding member 35*a*, the position of which is downstream of the nip area between the nip area member 32 and the pressing roller 34, in the moving direction of the fixing belt 33. More specifically, the protrusion 35 is disposed at the position closer to the side close to the heating roller 31 than to the side close to the nip area member 32 in the fastening member 32*a*. The protrusion 35 continuously extends along the width direction of the fixing belt 33 in an image forming area and is in contact with the inner surface of the fixing belt 33. In this case, the heating roller 31 is disposed on a lower level than the nip area member 32.

In this configuration, after being heated by the heating roller 31, the fixing belt 33 goes directly into the nip area between the nip area member 32 and the pressing roller 34 without coming into contact with the fastening member 32*a* and the protrusion 35, which reduces the heat loss in the fixing belt 33. In addition, after going through the nip area between the nip area member 32 and the pressing roller 34, the fixing belt 33 is led by the protrusion 35 to the heating roller 31 without coming into contact with the fastening member 32*a*. This belt path enables the increase in the curvature of the fixing belt 33, which reduces the torque necessary for driving the fixing belt 33.

In the fixing device 30 of this embodiment, the protrusion 35 is a soft member made of felt or the like having an internal cavity. The protrusion 35 holds some lubricant g at the position to be in contact with the inner surface of the fixing belt 33. The lubricant g is fluoro grease, which has viscosity and good heat resistance, for example.

The protrusion 35 having these characteristics reduces the contact resistance between the fixing belt 33 and the protrusion 35, decrease the amount of heat conduction from the fixing belt 33 to the protrusion 35, and enables easy application of the lubricant g to the inner surface of the fixing belt 33 without any separate lubrication mechanism.

Figure 3:
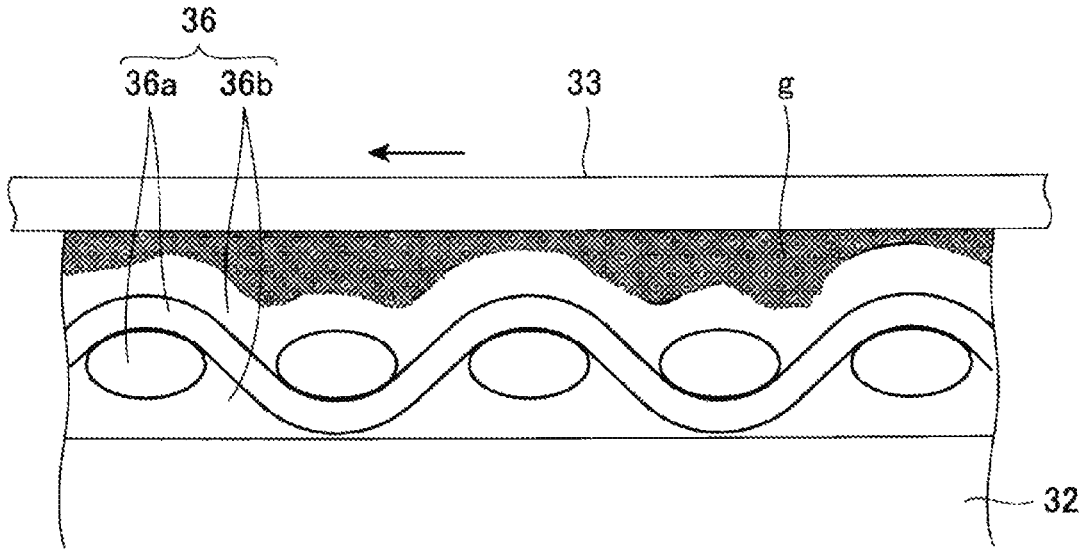
FIG. 3 is a partial cross-sectional view of a sliding sheet between a nip area member and a fixing belt in the fixing device according to the embodiment.

As shown in FIGS. 2 and 3, in the fixing device 30 of this embodiment, a sliding sheet 36 is disposed at least between the nip area member 32 and the fixing belt 33.

In this embodiment, the sliding sheet 36 includes a sheet material 36*a* made of glass fiber and covered with fluoro resin 36*b*. The sliding sheet 36 has an uneven surface facing the fixing belt 33 for holding the lubricant g such as fluoro grease having viscosity and good heat resistance as in the protrusion 35.

The sliding sheet 36 having these characteristics prevents heat transmission from the fixing belt 33 to the nip area member 32 to enable the nip area member 32 to resist a higher heating temperature, reduces the contact resistance between the fixing belt 33 and the nip area member 32 to restrict the increase in driving torque, and enables easy application of the lubricant g to the inner surface of the fixing belt 33.

In the fixing device 30 of the above embodiment, the protrusion 35 is disposed downstream of the nip area between the nip area member 32 and the pressing roller 34 in the moving direction of the fixing belt 33, however, the position of the protrusion 35 is not limited to this position.

Figure 4:
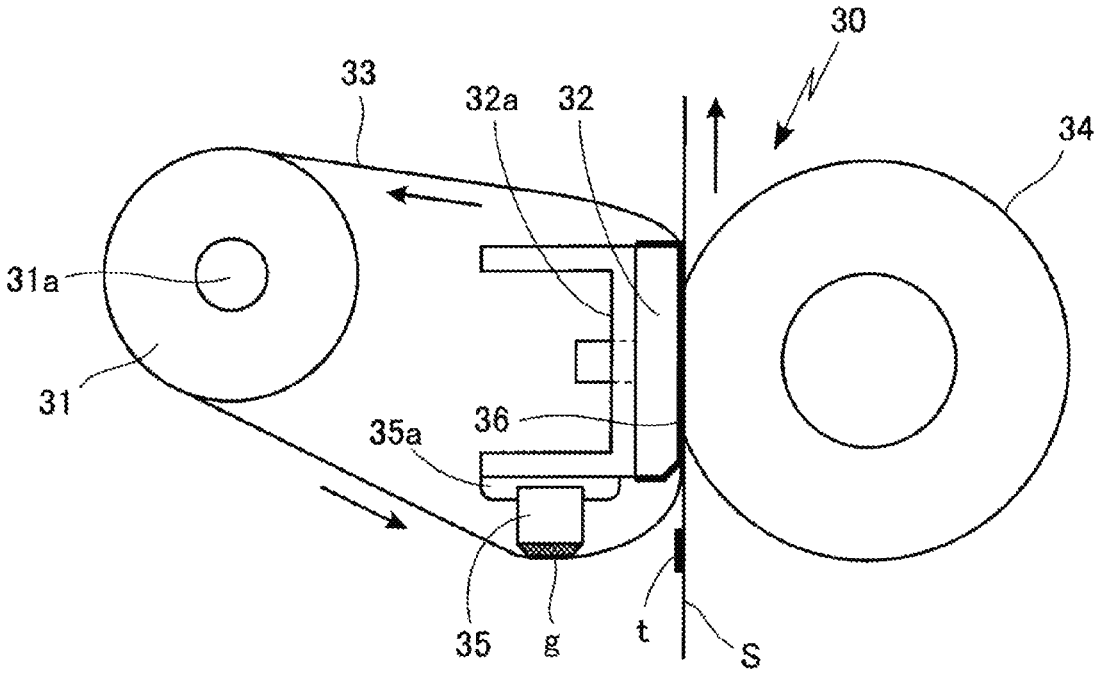
FIG. 4 is a schematic view of a first modified embodiment of the fixing device according to the embodiment.

For example, as shown in FIG. 4, the protrusion 35 may be disposed upstream of the nip area between the nip area member 32 and the pressing roller 34 in the moving direction of the fixing belt 33 to be in contact with the inner surface of the fixing belt 33. In this case, the heating roller 31 is disposed on a higher level than the nip area member 32. This configuration prevents the portion of the fixing belt 33 heated by the heating roller 31 from coming into contact with the fastening member 32*a*. In this case, however, the portion of the fixing belt 33 heated by the heating roller 31 comes into contact with the protrusion 35 before going into the nip area between the nip area member 32 and the pressing roller 34, which may result in the heat loss due to heat transmission from the fixing belt 33 to the protrusion 35.

Figure 5:
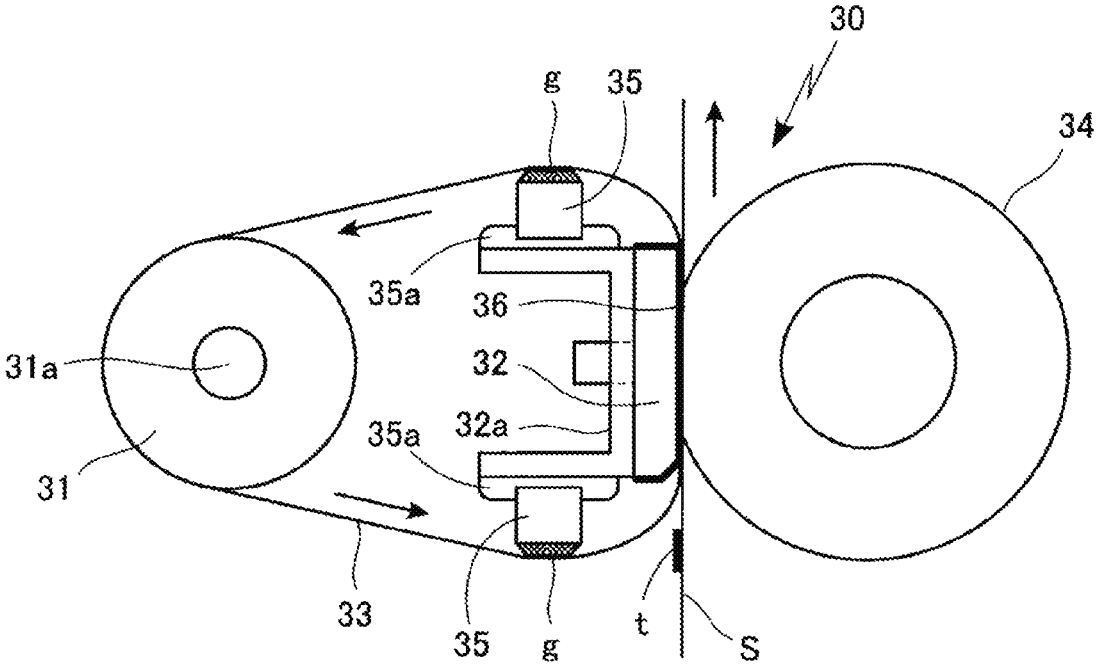
FIG. 5 is a schematic view of a second modified embodiment of the fixing device according to the embodiment.

Alternatively, as shown in FIG. 5, one protrusion 35 may be disposed upstream of the nip area between the nip area member 32 and the pressing roller 34 and another protrusion 35 may be disposed downstream of the nip area in the moving direction of the fixing belt 33 to be in contact with the inner surface of the fixing belt 33. In this case, the heating roller 31 is disposed so as to confront the nip area member 32. In this case, however, the inner surface of the fixing belt 33 is in contact with both of the protrusions 35 at the upstream and downstream positions in the moving direction of the fixing belt 33. As shown in FIG. 4, the portion of the fixing belt 33 heated by the heating roller 31 comes into contact with the upstream protrusion 35 before going into the nip area between the nip area member 32 and the pressing roller 34, which may result in the heat loss due to heat transmission from the fixing belt 33 to the upstream protrusion 35.

When one protrusion 35 is disposed upstream of the nip area where the pressing roller 34 presses the fixing belt 33 against the nip area member 32 and/or another protrusion 35 is disposed downstream of the nip area to be in contact with the inner surface of the fixing belt 33, the portion of the fixing belt 33 to be in contact with the heating roller 31 can be reduced to less than half of the circumference of the heating roller 31, which allows the diameter of the heating roller 31 to be reduced. This decreases the heat capacity of the heating roller 31 and thus reduces the amount of heat necessary for the heating and fixing operation.

Figure 6:
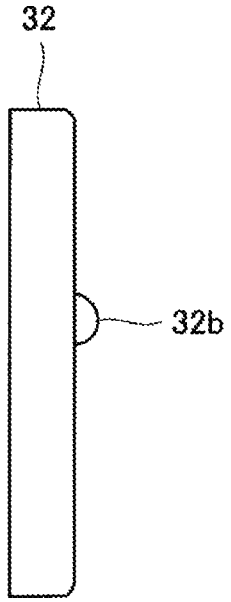
FIG. 6 is a partial view of the nip area member having a projection, which projects toward a pressing roller and extending along the width direction of the fixing belt, in the middle in the moving direction of the fixing belt in the fixing device according to the embodiment.

As shown in FIG. 6, the nip area member 32 may have a projection 32*b* in the middle in the moving direction of the fixing belt 33. The projection 32*b* projects toward the pressing roller 34 and extends along the width direction of the fixing belt 33. The fixing belt 33 is pressed harder at the projection 32*b* by the pressing roller 34, which facilitates the heating and fixing operation and allows for a lower heating temperature.

According to an embodiment of the present invention, in the fixing device according to an embodiment of the present invention, one protrusion is disposed upstream of the nip area where the pressing member presses the fixing belt against the nip area member and/or another protrusion is disposed downstream of the nip area to be in contact with the inner surface of the fixing belt. The protrusion(s) prevent(s) the inner surface of the fixing belt from coming into contact with other areas than the heating area of the heating member and the nip area. Even if the heating member such as a heating roller for holding the fixing belt has a small diameter, this configuration decreases the area of the fixing belt to be in contact with other areas than the heating area and the nip area, which reduces the heat loss during the heating and fixing operation.

As a result, an image forming apparatus including such a fixing device can reduce the costs for heating and fixing a toner image, which has been formed on a recording medium, on the recording medium.

Although embodiments of the present invention have been described and illustrated in detail, it is clearly understood that the same is by way of illustration and example only and not limitation, the scope of the present invention should be interpreted by terms of the appended claims.

What is claimed is:

1. A fixing device comprising:

a heating roller having a rotational axis;

a fixing belt disposed around the heating roller and a nip area member to be held by the heating roller and the nip area member, and rotatably held by the heating roller;

a pressing member that presses the fixing belt against the nip area member while being rotationally driven, wherein the fixing belt is pressed and rotationally driven by the pressing member, and a toner image is fixed on a recording medium in a nip area where the pressing member presses the fixing belt against the nip area member; and one protrusion disposed downstream of the nip area in the moving direction of the fixing belt to be in contact with the inner surface of the fixing belt so as to deform the fixing belt into a curved shape, wherein the heating roller is disposed upstream of the nip area in the moving direction of the fixing belt and at a lower level from a ground than the nip area member, the protrusion is connected to the nip area member, and the protrusion and the nip area member separately contact the fixing belt, the nip area member is securely held by a grooved fastening member and in contact with the fixing belt, and the protrusion is disposed on the fastening member via a heat-insulating holding member at a position different from the position for the nip area member.

2. The fixing device according to claim 1, wherein the protrusion is a soft member having an internal cavity.

3. The fixing device according to claim 1, wherein the protrusion continuously extends in the width direction of the fixing belt in an image forming area.

4. The fixing device according to claim 1, wherein the fixing belt is in contact with the nip area member while being out of contact with the fastening member.

5. The fixing device according to claim 1, wherein a sliding sheet is disposed at least between the nip area member and the fixing belt.

6. The fixing device according to claim 5, wherein the sliding sheet includes a sheet material made of glass fiber and covered with fluoro resin.

7. The fixing device according to claim 5, wherein the sliding sheet has an uneven surface facing the fixing belt for holding lubricant.

8. The fixing device according to claim 1, wherein the protrusion applies lubricant to the inner surface of the fixing belt.

9. The fixing device according to claim 8, wherein the lubricant is viscous grease.

10. The fixing device according to claim 8, wherein the lubricant is fluoro grease.

11. An image forming apparatus comprising:

an image forming part that forms a toner image on a recording medium; and the fixing device according to claim 1.

12. A fixing device comprising:

a heating roller having a rotational axis;

a fixing belt disposed around the heating roller and a nip area member to be held by the heating roller and the nip area member, and rotatably held by the heating roller;

a pressing member that presses the fixing belt against the nip area member while being rotationally driven, wherein the fixing belt is pressed and rotatably driven by the pressing member, and a toner image is fixed on a recording medium in a nip area where the pressing member presses the fixing belt against the nip area member; and a protrusion disposed upstream of the nip area in the moving direction of the fixing belt to be in contact with the inner surface of the fixing belt so as to deform the fixing belt into a curved shape, wherein the heating roller is disposed downstream of the nip area in the moving direction of the fixing belt and at a higher level from a ground than the nip area member, the protrusion is connected to the nip area member, and the protrusion and the nip area member separately contact the fixing belt, the nip area member is securely held by a grooved fastening member and in contact with the fixing belt, and the protrusion is disposed on the fastening member via a heat-insulating holding member at a position different from the position for the nip area member.

13. A fixing device comprising:

a heating roller having a rotational axis;

a fixing belt disposed around the heating roller and a nip area member to be held by the heating roller and the nip area member, and rotatably held by the heating roller;

a pressing member that presses the fixing belt against the nip area member while being rotationally driven, wherein the fixing belt is pressed and rotationally driven by the pressing member, and a toner image is fixed on a recording medium in a nip area where the pressing member presses the fixing belt against the nip area member; and one protrusion disposed upstream of the nip area and another protrusion disposed downstream of the nip area in the moving direction of the fixing belt to be in contact with the inner surface of the fixing belt so as to deform the fixing belt into a curved shape, wherein the heating roller is disposed to confront the nip area member, the protrusions are connected to the nip area member, and the protrusions and the nip area member separately contact the fixing belt, the nip area member is securely held by a grooved fastening member and in contact with the fixing belt, and the protrusions are disposed on the fastening member via a heat-insulating holding member at a position different from the position for the nip area member.

* * * * *